United States Patent [19]

Beehler

[11] 4,299,278

[45] Nov. 10, 1981

[54] CONTROL SYSTEM FOR WELL HEATING BY STEAM

[76] Inventor: Vernon D. Beehler, 1485 Dwight Dr., Glendale, Calif. 91207

[21] Appl. No.: 161,586

[22] Filed: Jun. 20, 1980

[51] Int. Cl.[3] ..... E21B 34/16; E21B 36/00; E21B 43/24

[52] U.S. Cl. ..... 166/53; 166/57; 166/64; 166/65 R; 166/303

[58] Field of Search ..... 166/57, 61, 67, 65 R, 166/64, 66, 75 R, 53, 97, 303, 272, 250, 252

[56] References Cited

U.S. PATENT DOCUMENTS

| | | | |
|---|---|---|---|
| 1,439,560 | 12/1922 | Lee | 166/303 |
| 2,347,769 | 5/1944 | Crites | 166/53 |
| 2,643,208 | 6/1953 | Ogden et al. | 166/67 |
| 2,828,821 | 4/1958 | Waterman | 166/57 |
| 2,871,948 | 2/1959 | Normand | 166/303 X |
| 3,066,737 | 12/1962 | Baldwin | 166/67 X |

*Primary Examiner*—Stephen J. Novosad
*Attorney, Agent, or Firm*—Vernon D. Beehler

[57] ABSTRACT

In a control system for delivery of steam at a predetermined pressure to the head of an oil well for use in an open orifice bottom hole heater, a boiler, remote from the well head, is connected by a steam delivery line through a series of valves with a steam pipe extending downwardly into the well to the orifice location near the bottom. In the steam delivery line is a main valve, downstream of which is a pressure regulator and upstream of which is a back pressure regulator. A sensing pressure line from the pressure regulator taps into the delivery line near the well head and a control line from the pressure regulator connected with the main valve control. A back pressure line from the back pressure regulator connects with the delivery line near the boiler and a control line from the back pressure regulator connects with the main valve control. Simultaneous control by the two regulators maintains a constant preset pressure at the well head thereby to maintain a fixed constant temperature for the crude oil at the bottom of the well.

11 Claims, 5 Drawing Figures

CONTROL SYSTEM FOR WELL HEATING BY STEAM

This is an improvement on U.S. Pat. No. 2,828,821, issued Apr. 1, 1958, which makes use of a constantly open restricted orifice and a pipe-like heat exchanger at the bottom of a well for heating the producing strata and the production fluid therefrom.

The prior art as represented by the patent employs a substantially conventional steam pipe to convey steam under relatively low pressure from the well head at the surface to the bottom of the hole. Near the bottom of the hole is an orifice fitting containing an orifice of capacity sufficient to pass all of the condensate accumulated by the heat exchanging activity but insufficient to pass steam.

Although an open orifice heater of this type is capable of operating as described, when steam pressure from an accompanying boiler is set by hand in order to establish desirable heating characteristics at the bottom of the hole, the operation requires an unnecessary amount of attention and maintenance, and is prone to fluctuate during the course of production with consequent disadvantage to continued dependable production. Inasmuch as heaters of this type are largely used in oil wells, the production fluid as a consequence is a mixture of crude oil and water, the water coming both from natural sources and condensate from the heat exchanger.

When heating of oil wells is undertaken with equipment of this kind a single boiler unit is called upon as a matter of economy to service a number of wells. This means that steam must travel often an appreciable distance from the boiler to one or another of a group of wells. Also, because conditions at the bottom of the well tend to vary appreciably, it has not heretofore been easy to maintain a proper temperature level at the bottom of the well for best results. Some variation in temperature under different conditions is normally expected, but, once an optimum condition has been established, it then becomes highly desirable to have the heating apparatus function consistently without variation whereby to maintain an optimum amount of production.

Also, by reason of the fact that installations of the type made reference to are often in isolated locations where frequent attendance on them is difficult or costly, heating installations should be capable of continued unvaried and dependable performance over relatively long periods of time without need for attention, servicing or maintenance to any appreciable degree.

In the well itself when an open orifice type heater is employed the most efficient results are obtained when the heat exchanging portion of the pipe line to the bottom of the well remains immersed in fluid. Consequently, it is of great advantage to so control the steam pressure at the top of the well which is at the top of the heat exchanging pipe, once the proper temperature of fluid has been established, that the temperature can be kept at the desired level by keeping careful control of the steam pressure present in the steam supply line and consequently in the heat exchanging pipe which extends downwardly into the well.

It is therefore among the objects of the invention to provide a new and improved control system for delivery of steam at a selected pressure at the upper end of the heat exchanging pipe in such a device so that the steam pressure can be held dependably constant at the well head irrespective of where the boiler or steam generator may be located.

Another object of the invention is to provide a new and improved control system for delivery of steam at a selected pressure at the well head which makes it possible to locate the steam boiler wherever convenient by merely having a main steam valve in the immediate proximity to the well which is being serviced.

Still another object of the invention is to provide a new and improved control system for delivery of steam at a selected pressure to a well head wherein pressure at the well head is regulated by a sensing line tapped into the steam delivery line so that any variation in demand for steam is immediately reflected in performance of the main steam valve whereby a proper and adequate amount of steam is assured at all times.

Still another object of the invention is to provide a new and improved control system for delivery of steam at a selected pressure at a well head wherein the steam pressure is maintained constant and wherein also the steam when it is delivered is relatively dry, thereby minimizing the amount of condensate passed into the well itself.

Still another object of the invention is to provide a new and improved control system for delivery of steam at a selected pressure wherein the temperature of the production fluid is sensed by an electric sensor in a manner such that an electric temperature controlled relay is made use of to actuate the main steam valve in a manner adapted to provide steam at proper pressure.

With these and other objects in view, the invention consists of the construction, arrangement, and combination of the various parts of the device, whereby the objects contemplated are attained, as hereinafter set forth, pointed out in the appended claims and illustrated in the accompanying drawings.

Figures 1, 2:
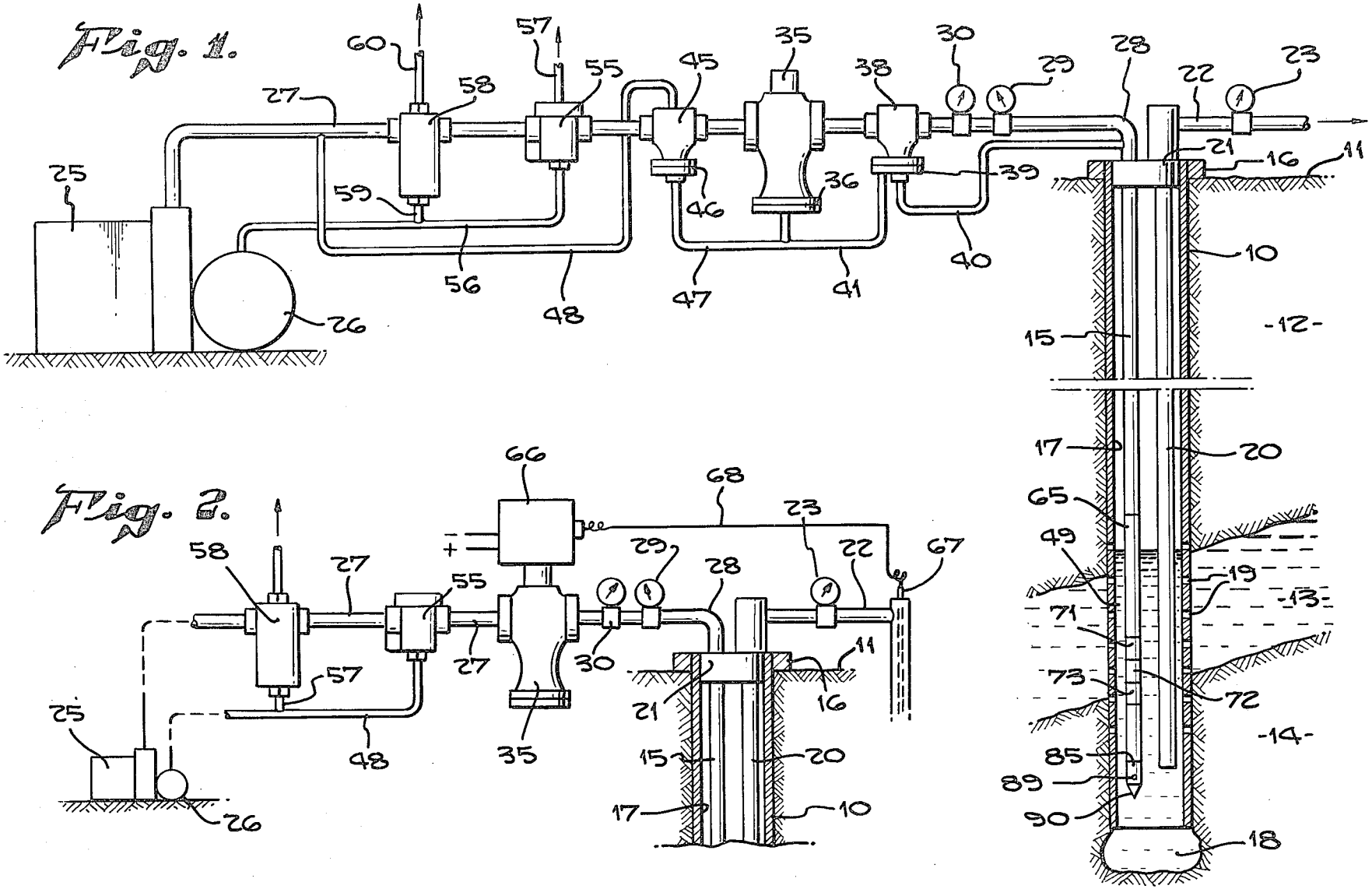
FIG. 1 is a schematic view of the control system shown attached to a heat exchanger pipe in a well.
FIG. 2 is a schematic representation of a second form of the invention which makes use of the same type of boiler as a heat source.

In an embodiment of the invention chosen for the purpose of illustration reference is first made to the general set up which shows in FIGS. 1 and 2 an oil well casing 10 which extends from ground surface 11 through a non-producing strata 12 and a producing strata 13 terminating in a non-producing strata 14.

A steam conducting pipe 15 extends from the well head 16 downwardly within the chamber 17 to a location adjacent the bottom 18. Crude oil from the producing strata 13 flows through perforations 19 into the chamber 17 and is pumped upwardly by conventional means through a producing line 20. The producing line 20 and steam conducting pipe 15 pass through a closure 21 which in effect, seals the chamber 17. An extension 22 of the production line delivers the production fluid to a suitable location. In the extension 22 is a temperature gauge 23.

Steam under pressure for supplying the steam conducting pipe 15 and accordingly for heating the well, is generated in a boiler 25 and a water tank 26 supplies feed water from the boiler. A main steam delivery line 27 extends from the boiler 25 to the steam conducting pipe 15 at a junction 28. Adjacent the junction, which means adjacent the well head 16, in the main steam delivery line, is a pressure gauge 29 and a temperature gauge 30.

In the main steam delivery line 27 is a main steam valve 35 provided with a conventional control 36 which can be of a diaphragm type subject to operation as the result of pressure variations. An acceptable main valve is one identified as Spence single seat metal diaphragm controlled valve. The main valve 35 is preferably located relatively near the particular well which is being supplied from the boiler 25 which can be located at a relatively remote location.

In the main steam delivery line 27 downstream with respect to the main valve 35 but upstream with respect to the pressure and temperature gauges 29 and 30 is positioned a pressure regulator 38 activated by a pressure responsive diaphragm unit 39. For activating the pressure regulator there is provided a sensing line 40 which taps into the steam conducting pipe 15, at the top adjacent the junction 28 from which it conducts a sensing pressure to the pressure responsive diaphragm unit 39 of the pressure regulator 38. A control line 41 connects between another portion of the pressure responsive diaphragm unit 39 and the control 36 of the main steam valve 35.

To additionally regulate manipulation of the main steam valve 35 there is provided a back pressure regulator 45 in the main steam delivery line 27 immediately upstream with respect to the main steam valve 35. A control responsive diaphragm unit 46 of the back pressure regulator is connected by a control line 47 to the control 36 of the main steam valve 35. A back pressure line 48 connects between the back pressure regulator 45 and the main steam line 27 at a location more nearly adjacent the boiler 25. A suitable back pressure regulator 45 is one identified as Type F14 Back Pressure Pilot by Spence Engineering. A corresponding suitable regulator is one identified as Type D Pressure Pilot by Spence Engineering.

The main steam valve and accompanying pressure regulator and back pressure regulator herein above described constitute control apparatus for maintaining a steam pressure level at the junction 28 which will maintain a temperature in a fluid sump 49 at a desired level.

Although the desired temperature may vary appreciably with local conditions depending in part on the specific gravity of the fluid in the sump 49 a typical acceptable temperature is about 150° F. For a well where the sump is located about 2000 feet below the well head 16 and the temperature is held at 150° F., it has been found that a steam pressure of about 123 pounds per square inch should be maintained at the well head. This presumes a main steam line having the capacity of a one inch line. To maintain pressure at the well head at about 123 pounds plus or minus 2 pounds, the boiler 25 should be capable of generating steam at 150 pounds per square inch pressure where the boiler is at a distance from the well head. In a system of the capacity herein made reference to, with the pressure regulator 38 set at 123 pounds per square inch and with boiler pressure generated at 150 pounds per square inch, the back pressure regulator 45 should be set at approximately 130 pounds per square inch. The length of the one inch steam delivery line can be permitted to vary appreciably depending in part on how well the steam delivery line may be insulated. For different distances and varied installations and especially where the boiler is serving multiple wells, the boiler pressure may need to be set, usually at a somewhat higher level.

Because the condensate derived from the heating operation in the chamber 17 is discharged into the bottom of the well, it is desirable that the steam which is passed to the steam conducting pipe 15 be as dry as possible. In the interest of extracting surplus moisture from steam in the main delivery line 27, there is provided a trap 55 located in the main steam line upstream of the back pressure regulator 45. A condensate return line 56 is connected between the trap and the water tank 26. The trap is one preferably with an air outlet 57. Additionally there is provided a separator 58 also connected in the main steam delivery line 27 upstream of the back pressure regulator 45 and also upstream of the trap 55. A condensate fitting 59 at the bottom of the separator connects to the return line 56 whereby to return condensate from the separator to the water tank 26. The separator is also provided with an air outlet 60.

On those occasions where a one-inch main steam delivery line 27 is employed, a one-quarter inch line is found satisfactory for the sensing line 40. Similar one-quarter inch control lines 41 and 47 also serve a set up of this capacity, which is also served satisfactorily by a one-quarter inch back pressure line 48.

Although reference has been made to the trap 55 and separator 58 as directed to extracting moisture from the main steam delivery line, this equipment also serves to bleed off air which would otherwise be passed through the system, down the steam conducting pipe 15 and ultimately become stratified in the space immediately above the level of fluid in the sump 49. Such air if not bled off, would have the effect of reducing the amount of steam in a heat exchanging portion 65 of the steam conducting pipe 15 causing temperature of fluid in the sump 49 to drop as well as temperature in the discharge line 20 and its extension 22. This then would cause an increase in steam pressure at the well head which could be expected to blow air outwardly with the condensate necessitating a resetting of the gauges 29 and 30 to new temperatures. The trap 55 and separator 58 therefore become significant adjuncts for the maintenance of an optimum condition in the well.

In a second form of the invention as shown in FIG. 2, the main steam valve 35 is controlled by an electrically actuated temperature control sensor relay 66 of substantially conventional construction. The relay 66 is triggered by a sensor 67 located in the extension 22 of the production line 20 and is connected to the relay 66 by an electric line 68. In this way steam pressure in the main steam delivery line 27 is controlled so as to deliver steam at the well head adjacent the junction 28 as demanded by temperature of the production fluid when discharged from the well head. When this system of control is employed, the pressure regulator 38 and back pressure regulator 45 are dispensed with. In other respects the system remains the same as that described in connection with FIG. 1.

Figure 3A:
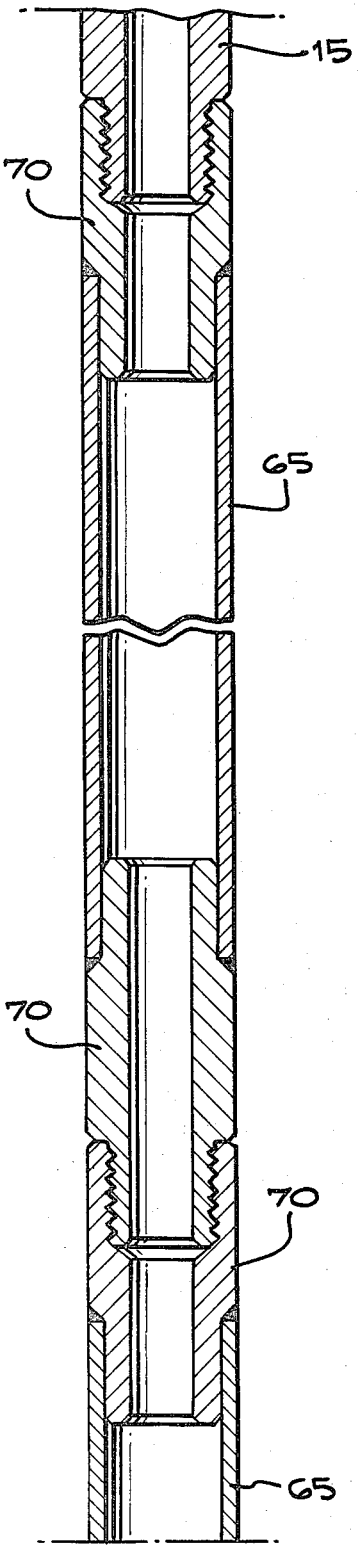
FIG. 3A is a longitudinal sectional view at the upper end of that portion of the steam pipe in the well which serves as a heat exchanger.
Figure 3B:
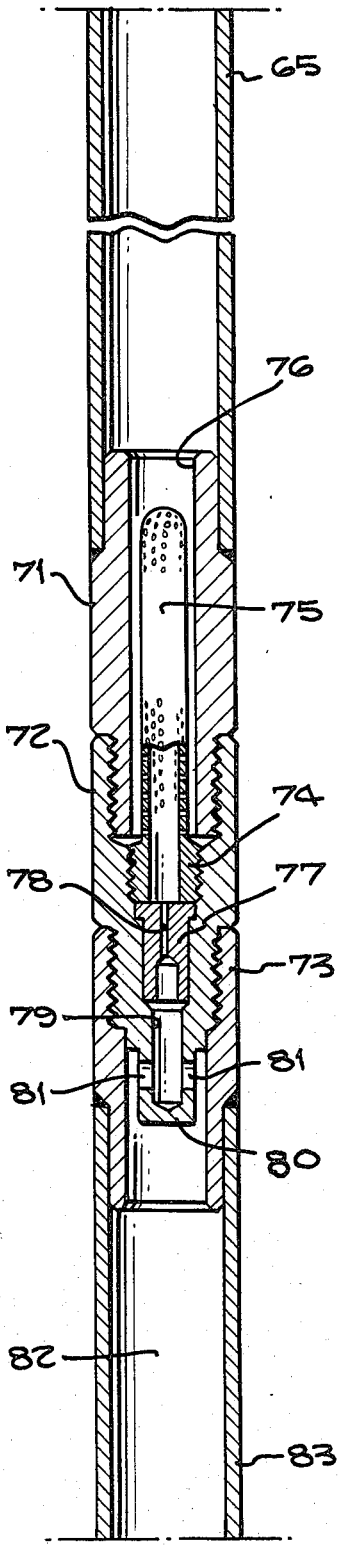
FIG. 3B is a longitudinal sectional view of the lower section of the heat exchanger portion and the constantly open orifice fitting.
Figure 3C:
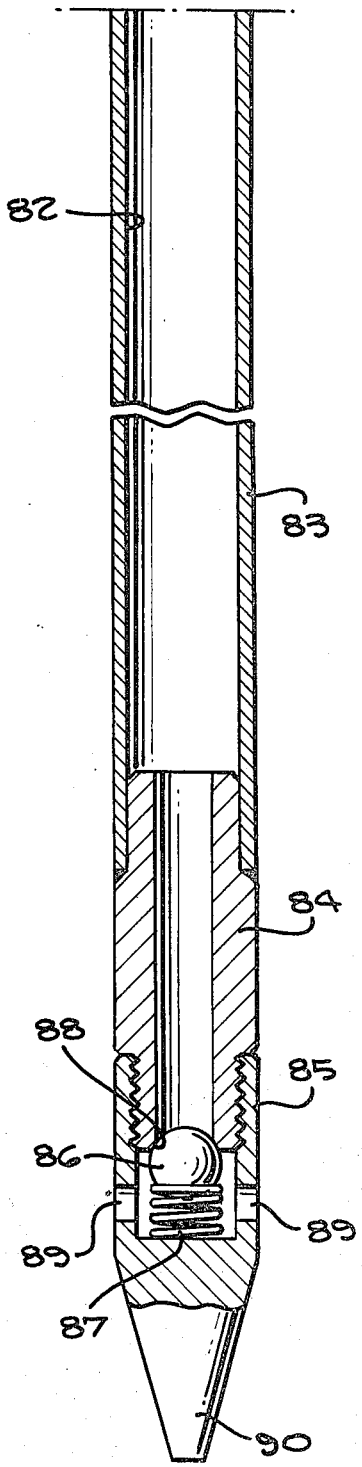
FIG. 3C is a longitudinal sectional view of the bottom end of the steam conducting pipe.

In FIGS. 3A, 3B, and 3C are shown details of the heat exchanger portion of the system previously identified by the reference character 65. As shown in FIG. 3A a fitting 70 connects the steam conducting pipe 15 with the heat exchanger portion 65. When pipe of standard lengths of about twenty-one feet are employed several lengths may be needed for the heat exchanger portion 65 which preferably extends throughout the entire depth of the producing strata 13. This will vary appreciably with local conditions, typical of which is a strata of about 200 feet thickness.

At the lower end of the lowermost section of the heat exchanger portion 65 is a composite fitting consisting of parts 71, 72 and 73. These parts may also be described as constituting a composite orifice fitting. In the upper portion of the fitting part 72 is a threaded strainer plug 74 which supports a strainer 75 which, as shown, extends through the bore 76 in the fitting part 71 but may also advantageously extend further upwardly into the heat exchanger portion 65. An orifice plug 77 located below the strainer plug 74 in the fitting part 72 provides a constantly open orifice 78 which discharges into an outlet bore 79 in a boss 80. Lateral branches 81 of the bore 79 direct condensate from the operation into a condensing and condensate passage 82 in a pipe section 83. At the bottom of the pipe section 83 is a fitting 84 to which is connected a check valve fitting 85 with a ball check 86 impelled by a spring 87. Condensate passing the ball check 86 is discharged through lateral branches 89 into the bottom of the sump 49, as shown in FIG. 1. By reason of this condensate water from the heat exchanger which is distilled water mixes with the production fluid from the strata 13 and is pumped as a mixture upwardly through the production line 20.

A tapered end 90 on the check valve fitting 85 improves the ease with which the steam conducting pipe 15 and its heat exchanger portion 65 is lowered into the well when the installation is made. At that time the ball check 86 is effectively closed so that fluid will not contaminate the condensing and condensate passage 82. The spring 87 is, however, a relatively lightweight spring so as to provide pressure against the ball check of no more than about ten or fifteen pounds but in any event, a very light pressure sufficient only to close the ball check during installation and to permit opening freely when condensate is to be discharged.

Moreover in a typical installation where conditions are substantially as have been heretofore described, the orifice 78 will serve effectively to pass all of the condensate at a rate which will throttle back the steam when it has a diameter of about 0.1405 inches, namely, the diameter of a hole made with a number 28 drill. Although the diameter of the orifice is of some criticality, an acceptable diameter may be one varying by some fractions of an inch from the hole made by such a number 28 drill.

Having described the invention, what is claimed as new in support of Letters Patent is as follows:

1. In a bottom hole steam heater for wells having a production line for carrying production fluid from the well head wherein the heater comprises a steam conducting pipe extending from the top of the well through producing strata and a constantly open restricted orifice adjacent the bottom of the pipe for discharge of condensate, a control system for delivery of steam at a selected pressure at the upper end of the steam conducting pipe from a source of steam under pressure higher than said selected pressure, said system comprising a main steam delivery line from said source to the steam conducting pipe at the top thereof, a main steam valve in said delivery line, said main steam valve having a pressure responsive control, a pressure regulator in the delivery line downstream of the main steam valve, a steam pressure sensing line of capacity substantially less than the delivery line connected between the pressure regulator and the delivery line at a location adjacent the top of the well, a pressure control line of capacity substantially less than said delivery line connected between the pressure regulator and said pressure responsive control, and a back pressure regulator in the delivery line upstream of the main valve.

2. A control system as in claim 1 wherein the main steam valve is located adjacent the top of the well.

3. A control system as in claim 1 wherein there is a back pressure line of capacity substantially less than the delivery line connected between the back pressure regulator and the delivery line adjacent the source and a control line of capacity substantially less than the delivery line connected between the back pressure regulator and said pressure responsive control.

4. A control system as in claim 3 wherein there is a closure for said well adjacent the top thereof and wherein said production line and said steam conducting pipe pass through said closure.

5. A control system as in claim 3 wherein there is a steam trap in the delivery line upstream of said back pressure regulator and a condensate line connected between said trap and said source.

6. A control system as in claim 3 wherein there is a steam trap in the delivery line upstream of the back pressure regulator, a separator in the delivery line upstream of said trap and a condensate return line connected between said trap, said separator and said source.

7. A control system as in claim 3 wherein there is a temperature gauge and a pressure gauge in the delivery line adjacent the top of the steam conducting pipe.

8. A control system as in claim 3 wherein the steam pressure at the top of the steam conducting pipe is about 123 pounds and the steam pressure at said source is about 150 pounds.

9. In a bottom hole steam heater for wells having a production line for carrying fluid from the well and wherein the heater comprises a steam conducting pipe having a heat exchanging portion extending from the top of the well through producing strata and a constantly open restricted orifice adjacent the bottom of the heat exchanging portion for discharge of condensate, a control system for delivery of steam at a selected pressure at the upper end of the steam conducting pipe from a source of steam under pressure higher than said selected pressure whereby to maintain fluid in the well at a selected temperature, said control system comprising, a main steam delivery line from said source to the steam conducting pipe at the top thereof, a main steam valve in said delivery line, said main steam valve having an electrically responsive control, a heat responsive electrically actuated sensor in said production line at a location adjacent the top of the well, and an electrical connection between said sensor and said electrically responsive control whereby to continuously transmit temperature conditions to said electrically responsive control, said main steam valve being responsive to said control for delivering steam at a selected pressure to the steam conducting pipe.

10. A control system as in claim 9 wherein there is a steam trap and a separator respectively in the main steam line upstream from said main steam valve and a condensate return from said trap and said separator to said source.

11. A control system as in claim 9 including a closure for said well through which said steam conducting pipe and said production line pass.

* * * * *